US010316714B2

(12) United States Patent
Osada et al.

(10) Patent No.: US 10,316,714 B2
(45) Date of Patent: Jun. 11, 2019

(54) BLOW-BY GAS REDUCTION DEVICE

(71) Applicant: ISUZU MOTORS LIMITED, Shinagawa-ku, Tokyo (JP)

(72) Inventors: Hideki Osada, Fujisawa (JP); Eiji Matsushima, Saitama (JP)

(73) Assignee: ISUZU MOTORS LIMITED, Shinagawa-Ku, Tokyo (JP)

( * ) Notice: Subject to any disclaimer, the term of this patent is extended or adjusted under 35 U.S.C. 154(b) by 0 days.

(21) Appl. No.: 15/957,670

(22) Filed: Apr. 19, 2018

(65) Prior Publication Data

US 2018/0306075 A1 Oct. 25, 2018

(30) Foreign Application Priority Data

Apr. 20, 2017 (JP) ..... 2017-083473

(51) Int. Cl.
*F01M 13/04* (2006.01)
*F01M 13/00* (2006.01)

(52) U.S. Cl.
CPC ..... *F01M 13/04* (2013.01); *F01M 2013/005* (2013.01)

(58) Field of Classification Search
CPC ..... F01M 13/04; F01M 2013/0422; F01M 2013/0427; F01M 2013/0433; F01M 2013/0438; F01M 2013/045; F01M 2013/0461; F01M 2013/0488; F01M 2013/0494
See application file for complete search history.

(56) References Cited

U.S. PATENT DOCUMENTS

2010/0319665 A1* 12/2010 Li ..... F01M 1/04 123/573
2014/0130493 A1* 5/2014 Spix ..... F01M 13/023 60/599
2016/0290193 A1* 10/2016 Lemke ..... F02M 25/06

FOREIGN PATENT DOCUMENTS

JP H06-288218 A 10/1994
JP 2004-137964 A 5/2004
JP 2007-231895 A 9/2007

* cited by examiner

*Primary Examiner* — Jacob M Amick
(74) *Attorney, Agent, or Firm* — Procopio, Cory, Hargreaves & Savitch LLP

(57) ABSTRACT

A blow-by gas reduction device includes: a gas return pipe, one end of which is connected to an engine and the other end of which is connected to an intake pipe, to return a blow-by gas in the engine to an intake side; an oil separator that is connected to the gas return pipe; an oil return pipe that is connected to the oil separator and is disposed with an inclination so as to return the oil to an inside of the engine; and a check valve that is provided in the oil return pipe, wherein the oil return pipe between the oil separator and the check valve is formed such that that the oil return pipe located at the check valve side is located at a lower side everywhere as compared with the oil return pipe located at the oil separator side.

4 Claims, 1 Drawing Sheet

BLOW-BY GAS REDUCTION DEVICE

CROSS-REFERENCE TO RELATED APPLICATION

This application claims priority from Japanese Patent Application No. 2017-083473 filed on Apr. 20, 2017, the entire subject matter of which is incorporated herein by reference.

TECHNICAL FIELD

This disclosure relates to a blow-by gas reduction device.

BACKGROUND

A blow-by gas reduction device mounted in a vehicle includes an oil separator and is configured such that the oil separator separates oil from a blow-by gas, and then the blow-by gas is returned to an intake side. The oil separated by the oil separator is returned into a crankcase of an engine through an oil return pipe.

SUMMARY

Incidentally, the oil return pipe is generally inclined such that the side of the crankcase becomes lower, and a check valve is connected to the oil return pipe so as to prevent backflow of the oil. The check valve is closed by an internal pressure of the crankcase during traveling of the vehicle, and is opened when the engine stops. For this reason, it hardly occurs that oil is blown up to the oil separator side during normal driving.

However, when the vehicle is driven under specific conditions, there is a possibility that the oil will flow back to the intake side.

These specific conditions will be described.

The oil return pipe has a place at which the oil return pipe becomes partially horizontal. For this reason, when the vehicle is inclined such that the inclination of the oil return pipe becomes gentle, the place at which the oil return pipe is horizontal becomes an inverse slope, and the oil is collected in the place.

When the internal pressure of the crankcase is high, the check valve is completely closed by receiving the pressure. However, for example, when the engine is in an idling operation, the internal pressure of the crankcase is low, and the check valve becomes an unstable state that the check valve is opened and closed according to variation of the internal pressure of the crankcase. For this reason, in a case where the vehicle is inclined such that the inclination of the oil return pipe becomes gentle during the idling, the oil collected in the horizontal place of the oil return pipe may be blown up to the oil separator side due to a gas flowed backward from the crankcase.

Therefore, this disclosure is to provide a blow-by gas reduction device capable of preventing or suppressing backflow of oil from an oil return pipe to an oil separator.

According to an aspect of this disclosure, a blow-by gas reduction device includes: a gas return pipe, one end of which is connected to an engine and the other end of which is connected to an intake pipe, to return a blow-by gas in the engine to an intake side; an oil separator that is connected to the gas return pipe to separate oil contained in the blow-by gas; an oil return pipe that is connected to the oil separator and is disposed with an inclination so as to return the oil to an inside of the engine; and a check valve that is provided in the oil return pipe, wherein when an internal pressure of a crankcase in the engine exceeds an atmospheric pressure, the check valve is closed, wherein the oil return pipe between the oil separator and the check valve is formed with the inclination such that the oil return pipe located at the check valve side is located at a lower side everywhere as compared with the oil return pipe located at the oil separator side.

In the above described blow-by gas reduction device, the check valve may be disposed so that an inlet of the oil faces upwards in a vertical direction.

In the above described blow-by gas reduction device, the oil return pipe between the oil separator and the check valve may have an inclination of at least 15 degrees or greater everywhere.

In the above described blow-by gas reduction device, the engine may include a flywheel housing in which an outer periphery is formed in a circular arc shape, the oil separator is provided on the flywheel housing, and the oil return pipe may include an inclined portion linearly extending in a tangential direction of the flywheel housing and obliquely downward from the oil separator, and a vertical portion extending downwards in the vertical direction from a lower end of the inclined portion.

In the above described blow-by gas reduction device, the check valve may be connected to the vertical portion.

According to this disclosure, it is possible to prevent or suppress backflow of oil from the oil return pipe to the oil separator.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

An embodiment of this disclosure will be described below with reference to the accompanying drawings. It is noted that front, back, left, right, up, and down directions in an embodiment to be described below indicate directions of a vehicle, respectively.

Figure 1:
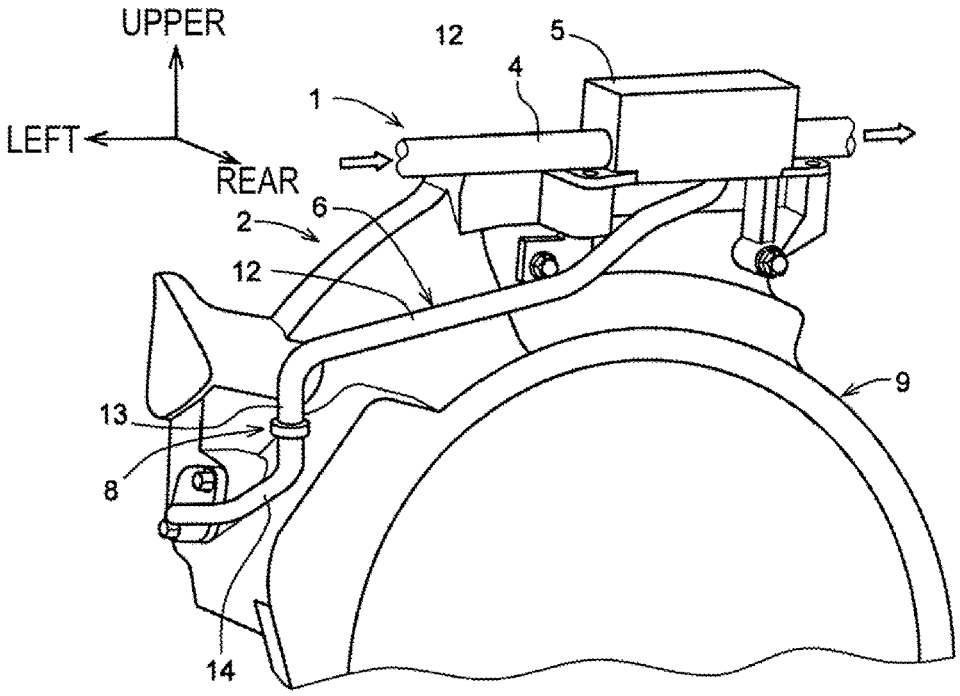
FIG. 1 is a perspective view illustrating a main part of a blow-by gas reduction device according to an embodiment of this disclosure.
Figure 2:
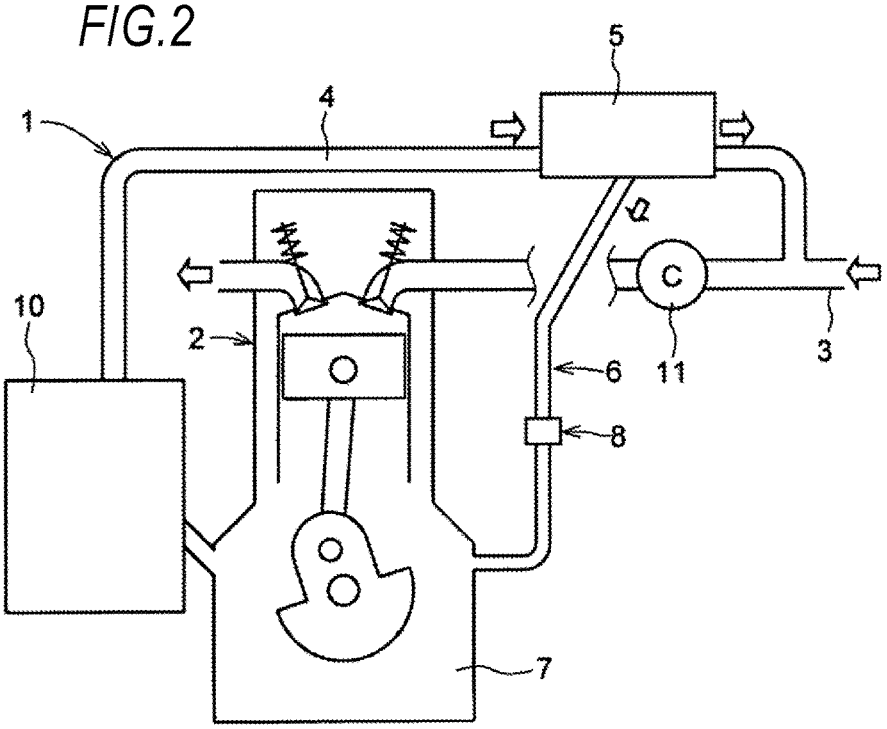
FIG. 2 is a schematic view of the entire blow-by gas reduction device.

FIG. 1 is a perspective view illustrating a main part of a blow-by gas reduction device 1 according to the embodiment. FIG. 2 is a schematic view of the entire blow-by gas reduction device 1. An engine (internal combustion engine) 2 provided with the blow-by gas reduction device 1 is a multicylinder compression ignition-type internal combustion engine mounted on a vehicle, that is a diesel engine. The arrangement form and the number of the cylinders in an engine 2 are arbitrary.

As illustrated in FIGS. 1 and 2, the blow-by gas reduction device 1 includes a gas return pipe 4 that is provided with one end connected to the engine 2 and the other end connected to an intake pipe 3 and is configured to return a blow-by gas in the engine 2 to an intake side, an oil separator 5 that is connected to the gas return pipe 4 to separate oil contained in the blow-by gas, an oil return pipe 6 that is connected to the oil separator 5 and is disposed with an inclination so as to return the oil to the inside of the engine 2, and a check valve 8 that is connected to the oil return pipe 6 and is closed when an internal pressure of a crankcase 7 of the engine 2 exceeds the atmospheric pressure.

The engine 2 includes a flywheel housing 9. The flywheel housing 9 has an outer periphery formed in a circular arc shape. An internal space of the flywheel housing 9 is connected to an internal space of the crankcase 7. Thus, the internal space of the flywheel housing 9 has the same pressure as the internal space of the crankcase 7. An oil separation chamber 10 for roughly separating oil droplets from the blow-by gas is formed in the engine 2 to be adjacent to the flywheel housing 9. The oil separation chamber 10 is connected to the internal space of the flywheel housing 9. Thus, the blow-by gas is introduced into the oil separation chamber 10 through the flywheel housing 9 from the crankcase 7. A compressor 11 of a supercharger is connected to the intake pipe 3.

One end of the gas return pipe 4 is connected to the oil separation chamber 10. In addition, the other end of the gas return pipe 4 is connected to the intake pipe 3 provided on an upstream side of the compressor 11.

The oil separator 5 is provided on the flywheel housing 9. The oil separator 5 includes a wall (not illustrated) for allowing the blow-by gas to collide therein. The oil separator 5 separates the oil from the blow-by gas by causing the blow-by gas to collide with the wall. Further, an oil outlet (not illustrated) is formed on a bottom of the oil separator 5. One end (upper end) of the oil return pipe 6 is connected to the oil outlet.

The oil return pipe 6 includes an inclined portion 12 linearly extending in a tangential direction of the flywheel housing 9 and obliquely downward from the oil separator 5, a vertical portion 13 extending downwards in a vertical direction from a lower end of the inclined portion 12, and a lower connection portion 14 extending obliquely downward from the lower end of the vertical portion 13 and connected to the inside of the flywheel housing 9.

The inclined portion 12 is connected to an outlet of the oil separator 5. The inclined portion 12 extends substantially in a linear shape and is inclined so that the check valve 8 located at the check valve side is located at a lower side everywhere as compared with the oil return pipe located at the oil separator side. In other words, the inclined portion 12 is successively lowered towards the check valve 8. In addition, the inclined portion 12 is formed so that an inclination angle is 15 degrees or greater everywhere. The numerical value of the inclination angle is set to be a value larger than the assumed maximum inclination angle of the vehicle. The numerical value is illustrative and can be appropriately changed.

The vertical portion 13 is connected to the other end (lower end) of the inclined portion 12. The vertical portion 13 extends substantially in a linear shape.

The check valve 8 is connected to the center in a longitudinal direction of the vertical portion 13. The check valve 8 includes a valve housing (not illustrated) forming a valve chamber (not illustrated) and a disk-like valve body (not illustrated) provided in the valve chamber so as to float up and down. The valve chamber is formed by partially expanding a diameter of a flow passage which vertically passes through the valve housing. A valve seat (not illustrated), on which the valve body is liquid-tightly seated, is formed on an upper inner surface of the valve chamber. In addition, a plurality of legs (not illustrated) are provided in a lower part of the valve chamber to support the valve body in a floating state from a lower inner surface of the valve chamber. The check valve 8 is completely closed when the valve body is seated on the valve seat by being raised by the pressure from the crankcase 7, and is opened when the valve body rests on the legs. The check valve 8 is not limited to the structure described above. The check valve 8 may have other structures.

The operation of the embodiment will be described below.

When the vehicle drives on an uphill or flat road, the internal pressure of the crankcase 7 becomes sufficiently higher than the atmospheric pressure. In addition, the intake pipe 3 on the inlet side of the compressor 11 has a negative pressure. Therefore, the blow-by gas in the crankcase 7 flows toward the intake pipe 3 through the flywheel housing 9, the oil separation chamber 10, and the gas return pipe 4.

The blow-by gas flowing into the oil separation chamber 10 is separated from the oil droplet having a relatively large particle size in the oil separation chamber 10, and then flows to the gas return pipe 4. The oil separated in the oil separation chamber 10 flows downwards due to its own weight, and returns to the inside of the crankcase 7 through the flywheel housing 9.

In addition, after the blow-by gas flowing into the gas return pipe 4 flows into the oil separator 5 and is separated from the oil having a small particle in the oil separator 5, the blow-by gas flows to the gas return pipe 4 on the side of the intake pipe 3. Thus, the blow-by gas is purified and does not contain oil.

Thereafter, the blow-by gas flowing into the gas return pipe 4 flows into the intake pipe 3, and is recirculated together with new air into a combustion chamber of the engine 2.

In addition, the oil separated by the oil separator 5 flows to the oil return pipe 6. At this time, the internal pressure of the crankcase 7 is transmitted to the valve chamber of the check valve 8 through the flywheel housing 9, the lower connection portion 14, and the vertical portion 13. For this reason, the valve body of the check valve 8 is crimped to the upper valve seat by the pressure transmitted from the crankcase 7. That is, the check valve 8 is completely closed. Therefore, the oil separated by the oil separator 5 and flowing into the oil return pipe 6 is collected in the vertical portion 13 above the check valve 8. Further, since the check valve 8 is completely closed, the blow-by gas does not flow backward over the check valve 8.

Thereafter, when the engine 2 is stopped by the stop of the vehicle, the internal pressure of the crankcase 7 is lowered, and the valve body of the check valve 8 also goes down. Accordingly, the check valve 8 is opened, and the oil collected in the vertical portion 13 above the check valve 8 returns to the inside of the crankcase 7 through the check valve 8 and the flywheel housing 9.

Further, when the engine 2 is started again and the engine 2 is brought into an idling state, the internal pressure of the crankcase 7 becomes slightly higher than the atmospheric pressure. Therefore, it is also conceivable that the valve body of the check valve 8 floats in the vertical direction and thus the check valve 8 is opened and closed unstably. In this case, at the moment of the opening of the check valve 8, the gas in the crankcase 7 flows backward into the oil return pipe 6.

Since the existing oil return pipe (not illustrated) has a partially horizontal place, when the vehicle is inclined in a direction in which the inclination of the oil return pipe becomes gentle, oil is collected in the horizontal place. For this reason, it is considered that the oil collected in the horizontal place may be blown back toward the oil separator 5 by the gas in the crankcase 7 that has flowed backward.

In the blow-by gas reduction device 1 according to the embodiment, however, the oil return pipe 6 is formed with an inclination on the upstream side of the check valve 8 such that the check valve 8 is located at a lower side everywhere. Therefore, even when the vehicle is inclined in a direction in which the inclination of the oil return pipe 6 becomes gentle, there is no place where the oil is collected. Accordingly, even when the gas in the crankcase 7 flows backward into the oil return pipe 6, there is no oil blown back into the oil return pipe 6 and the backflow of the oil to the oil separator 5 can be prevented or suppressed. Incidentally, the inclination described above means an inclination at which the oil can flow, and includes a vertical component (inclination angle 90 degrees).

In this way, since the oil return pipe 6 between the oil separator 5 and the check valve 8 is formed with the inclination so that the check valve 8 is located on the downward side everywhere, it is possible to prevent the oil from being collected in the oil return pipe 6 provided on the upstream side of the check valve 8 and to prevent or suppress the backflow of the oil from the oil return pipe 6 to the oil separator 5.

The check valve 8 is disposed so that the inlet of the oil faces upwards in the vertical direction, when the check valve 8 is opened. Therefore, the oil collected in the vicinity of the inlet of the check valve 8 can promptly flow toward the downstream side.

The oil return pipe 6 between the oil separator 5 and the check valve 8 has the inclination of at least 15 degrees or greater everywhere. Therefore, the inclination of the oil return pipe 6 on the road having a general inclination angle can be prevented or suppressed from being horizontal or inverted.

The oil return pipe 6 includes the inclined portion 12 linearly extending in the tangential direction of the flywheel housing 9 and obliquely downward from the oil separator 5 and the vertical portion 13 extending downwards in the vertical direction from the lower end of the inclined portion 12. Therefore, the oil return pipe 6 from the oil separator 5 to the check valve 8 can be formed with an inclination of a predetermined angle or more while effectively using the space of the outer periphery of the flywheel housing 9.

Although the embodiment of this disclosure is described in detail above, this disclosure can be realized by following embodiments.

(1) The gas return pipe 4 is connected to the oil separation chamber 10, but may be connected to the flywheel housing 9 or may be connected to the crankcase 7.

(2) The lower connection portion 14 of the oil return pipe 6 is connected to the flywheel housing 9, but may be connected to the crankcase 7 or may be connected to the oil separation chamber 10.

(3) The oil return pipe 6 includes the vertical portion 13, but may not include the vertical portion 13. In this case, the check valve 8 may be connected to the inclined portion 12.

The configurations of the embodiments described above can be combined partially or wholly unless there is no contradiction in particular. The embodiment of this disclosure is not limited to the above-described embodiment, and all modifications and applications contained within the spirit of this disclosure defined in the scope of claims, and its equivalents are included in this disclosure. Therefore this disclosure should not be interpreted in a limited manner and can be applied to other arbitrary technologies within the spirit of this disclosure.

What is claimed is:

1. A blow-by gas reduction device comprising:

a gas return pipe, one end of which is connected to an engine and the other end of which is connected to an intake pipe, to return a blow-by gas in the engine to an intake side;

an oil separator that is connected to the gas return pipe to separate oil contained in the blow-by gas;

an oil return pipe that is connected to the oil separator and is disposed with an inclination so as to return the oil to an inside of the engine; and a check valve that is provided in the oil return pipe, wherein when an internal pressure of a crankcase in the engine exceeds an atmospheric pressure, the check valve is closed, wherein the oil return pipe between the oil separator and the check valve is formed with the inclination such that the oil return pipe located at the check valve side is located at a lower side everywhere as compared with the oil return pipe located at the oil separator side, wherein the engine includes a flywheel housing in which an outer periphery is formed in a circular arc shape, wherein the oil separator is provided on the flywheel housing, and wherein the oil return pipe includes an inclined portion linearly extending in a tangential direction of the flywheel housing and obliquely downward from the oil separator, and a vertical portion extending downwards in the vertical direction from a lower end of the inclined portion.

2. The blow-by gas reduction device according to claim 1, wherein the check valve is disposed so that an inlet of the oil faces upwards in a vertical direction.

3. The blow-by gas reduction device according to claim 1, wherein the oil return pipe between the oil separator and the check valve has an inclination of at least 15 degrees or greater everywhere.

4. The blow-by gas reduction device according to claim 1, wherein the check valve is connected to the vertical portion.

* * * * *